United States Patent [19]

Apter

[11] Patent Number: 4,723,115

[45] Date of Patent: Feb. 2, 1988

[54] POWER LINE CORD FILTERING ASSEMBLY

[76] Inventor: Robert Apter, 10 Chemin des Vieux-Chenes, 1213 Geneve, Switzerland

[21] Appl. No.: 786,601

[22] Filed: Oct. 11, 1985

[51] Int. Cl.[4] ..... H01R 13/66

[52] U.S. Cl. ..... 333/181; 439/620

[58] Field of Search ..... 333/181, 185, 12; 339/147 R, 147 P, 143 R; 174/32; 439/620

[56] References Cited

U.S. PATENT DOCUMENTS

| | | | |
|---|---|---|---|
| 2,186,578 | 1/1940 | Doughman | 333/181 |
| 3,191,133 | 6/1965 | Texsier | 339/147 U X |
| 3,744,128 | 7/1973 | Fisher et al. | 339/143 R |
| 3,778,759 | 12/1973 | Carroll | 333/12 X |
| 4,259,705 | 3/1981 | Stifter | 333/12 X |
| 4,508,414 | 4/1985 | Kusui et al. | 339/143 R |

FOREIGN PATENT DOCUMENTS

| | | | |
|---|---|---|---|
| 0090744 | 10/1983 | European Pat. Off. | 339/147 R |
| 2042342 | 11/1971 | Fed. Rep. of Germany | 339/147 P |
| 2255527 | 5/1973 | Fed. Rep. of Germany | 339/147 P |
| 3148351 | 7/1985 | Fed. Rep. of Germany . | |

*Primary Examiner*—Eugene R. LaRoche
*Assistant Examiner*—Benny Lee
*Attorney, Agent, or Firm*—Fulwider, Patton Rieber, Lee & Utecht

[57] ABSTRACT

A power line cord filtering assembly for use with an electrical device and comprising a plug adapted to be connected to electrical mains, a power line cord and filter apparatus arranged in series with said plug, power line cord and electrical device, the filter comprising resistor apparatus, capacitor apparatus and inductor apparatus.

13 Claims, 2 Drawing Figures

POWER LINE CORD FILTERING ASSEMBLY

FIELD OF THE INVENTION

The present invention relates to electrical apparatus generally and more particularly to power line filters.

BACKGROUND OF THE INVENTION

Various types of power line filters are known in the patent literature and available on the market. These filters are useful for reducing high frequency electromagnetic interference (EMI) with the operation of electrical appliances, such as communications equipment, televisions, computers and the like. These filters are provided for reduction of conducted EMI, i.e. unwanted signals carried by the electrical current. Thus, these filters provide proteciton against conducted interference but not against interference due to radiation in the vicinity of the electrical line.

It is known from German DOS No 3148351 to provide an LC filter in a power cord for a television. It is also known to combine such a filter with a shielded power cord to provide additional protection against high frequency electromagnetic interference.

The prior art power cord filter arrangements, although they provide useful filtering do not provide as complete filtering as would be desired in many applications.

SUMMARY OF THE INVENTION

The present invention seeks to provide an improved power line cord filtering assembly which significantly increases the quality of the protection against electromagnetic interference.

There is thus provided in accordance with an embodiment of the present invention, a power line cord filtering assembly for use with an electrical device and comprising a plug adapted to be connected to electrical mains, a power line cord and filter apparatus arranged in series with said plug, power line cord and electrical device, the filter comprising a resistor apparatus, a capacitor apparatus and an inductor apparatus.

Additionally in accordance with a preferred embodiment of the invention, the inductor apparatus is connected facing the mains. Where the power line comprises phase, neutral and earth leads, an inductor preferably is provided facing the mains along each of the leads. The invention is also applicable to two wire power lines, including only phase and neutral leads.

There is further provided in accordance with an embodiment of the present, invention, a power line cord filtering assembly for use with an electrical device and comprising a plug adapted to be connected to electrical mains, a power line cord and filter apparatus arranged in series with said plug, power line cord and electrical device, the filter being connected between the plug and the power line cord, the power line cord being shielded and the shield being connected to ground only at the device side of the power line cord.

There is additionally provided in accordance with an embodiment of the present invention, a power line cord filtering assembly for use with an electrical device and comprising a plug adapted to be connected to electrical mains, a power line cord and filter apparatus arranged in series with said plug, power line cord and elecrical device, the filter being connected between the plug and the power line cord, the power line cord being shielded and the shield extending to substantially cover the plug and the filter. Preferably, the shield extends continuously from the power line and over the plug and filter so as to eliminate regions through which electromagnetic radiation can penetrate.

Preferably the connection between the shield and ground should be a low impedance connection, typically in the form of a conductor of a width of a least one cm.

Additionally in accordance with a preferred embodiment of the present invention, the capacitance between the shield and the earth lead should be at least 1000 picofarads.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
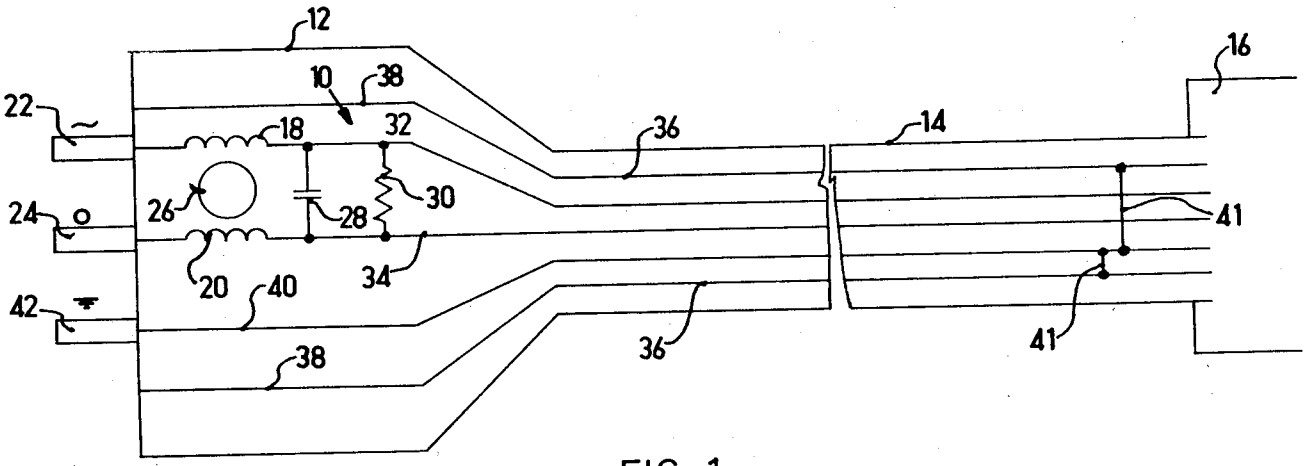
FIG. 1 is a schematic illustration of power line filter apparatus constructed and operative according to one embodiment of the present invention.

Reference is now made to FIG. 1 which illustrates one embodiment of the present invention, a power line cord filter 10, which is located in the plug 12 of a power line cord 14. The opposite end of the power line cord is connected to an electrical device 16, such as a television, computer, etc.

According to a preferred embodiment of the present invention, the filter 10 comprises first and second inductors 18 and 20 arranged in series with and facing the respective phase and neutral terminals 22 and 24 of the plug 12. First and second inductors 18 and 20 are preferably embodied in a current compensated coil about a base 26. A capacitor 28 and a resistor 30 are arranged in parallel across the phase and neutral lines 32 and 34.

According to a preferred embodiment of the present invention, the power line cord 14 comprises a shielded power line cord, such as cord having foil or braid shielding available from Belden Electronic Wire and Cable of Richmond, Ind., U.S.A.. The shielding of cord 14 is indicated by reference numeral 36.

Further in accordance with a preferred embodiment of the present invention, the plug 12 is also shielded, by shielding 38 which covers generally the entire plug and substantially the entire filter, whereby all openings through which substantial electromagnetic radiation can pass are eliminted. Preferably, the shielding 38 of plug 12 represents a continuation of the shielding 36 of cord 14 and is conductively connected thereto with a low impedance electrical connection.

Further in accordance with a preferred embodiment of the invention, shielding 36, and thus by implication, shielding 38 is connected to the ground line 40 at a location adjacent the device by a low impedance connection 41, such as a conductor of a width of at least 1 cm. The ground line 40 is terminated in ground pin 42. It is a particular feature of the present invention that the shielding is connected to ground only at a location adjacent the device 16 and not at the plug end of the cord, thus preventing the existence of circulating current therethrough and preventing magnetic coupling with adjacent fields.

Figure 2:
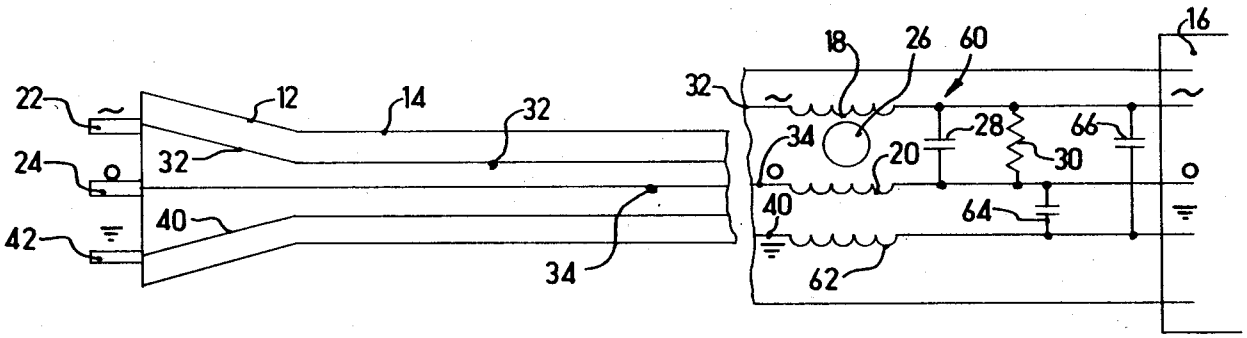
FIG. 2 is a schematic illustration of power line filter apparatus constructed and operative in accordance with an alternative embodiment of the present invention.

Reference is now made to FIG. 2 which illustrates an alternative embodiment of the invention wherein the filter is associated with the device end of the power cord. In this embodiment the filter apparatus may be disposed either at the device end of the power cord or alternatively associated therewith and located inside the device 16. The filter may be enclosed in plastic or in metal or a combination of both as appropriate. When a two conductor power line is employed, the cabinet may be connected to ground and serve as a ground connection for the filter and the shield.

Similarly to the embodiment of FIG. 1, the filter, here indicated by reference numeral 60, comprises first and second inductors 18 and 20 arranged in series with and facing the respective phase and neutral terminals 22 and 24 of the plug 12. First and second inductors 18 and 20 are preferably embodied in a current coil about a base 26. A capacitor 28 and a resistor 30 are arranged in parallel across the neutral lines 32 and 34.

Additionally there is preferably provided a third inductor 62 in series with the ground line 40 and ground pin 42. Additionally in accordance with a preferred embodiment of the present invention, capacitors 64 and 66 are connected between the ground line 40 and the neutral and phase lines 34 and 32 respectively. These capacitors provide desired filtering which is not necessarily required in the embodiment of FIG. 1 due to the presence of the grounded shielding.

Preferred component values according to a preferred embodiment of the invention are set forth hereinbelow:

Capacitor 28: 0.1–0.8 microfarad
Capacitor 64: 1000–3000 picrofarad
Capacitor 66: 1000–3000 picofarad
Resistor 30: approximately 1 megaohm
Inductor 18: 0.1–10 millihenries
Inductor 20: 0.1–10 millihenries
Inductor 62: 50–500 millihenries The precise component values will depend on the current rating of the power line filter.

It will be apparent to persons skilled in the art that the present invention is not limited by what has been particularly shown and described hereinabove. Rather the scope of the present invention is defined only by the claims which follow:

I claim:

1. A power line cord filtering assembly for use with an electrical device comprising:

a plug adapted to be connected to electrical mains;

a power line cord having a first end arranged to be connected to said plug and a second and arranged to be connected to an electrical device, said power line cord having an electromagnetic shield; and filter means arranged in series between said plug and said first end of said power line cord, said filter means comprising a plurality of inductors, each inductor connected in-line with a respective one of said mains, a capacitor shunt-connected across said mains and a resistor shunt-connected across said mains, wherein said power line cord shield is connected to ground only at the second end of said power line cord.

2. A power line cord filtering assembly for use with an electrical device according to claim 1 and wherein said power line cord comprises phase, neutral and ground leads, and said plurality of inductors comprises a pair of inductors, each inductor connected in-line with a respective one of said phase and neutral leads.

3. A power line cord filtering assembly for use with an electrical device according to claim 2 and wherein said filter means is lcoated in said plug.

4. A power line cord filtering assembly for use with an electrical device according to claim 1 and wherein said filter means is located in said plug.

5. A power line cord filtering assembly according to claim 4 and wherein said shield extends to substantially cover the plug and the filter.

6. A power line cord filtering assembly according to claim 4 and wherein said shield extends continuously from the power line cord and over the plug and filter so as to eliminate regions where electromagnetic radiation can penetrate.

7. A power line cord filtering assembly according to claim 4 and wherein the connection between the shield and ground is a low impedance connection.

8. A power line cord filtering assembly according to claim 4 and wherein a capacitance exists between the shield and a ground lead of said power line cord and has a value of at least 1000 picofarads.

9. A power line cord filtering assembly for use with an electrical device comprising:

a plug adapted to be connected to electrical mains;

a power line cord having a first end arranged to be connected to said plug and a second end arranged to be connected to an electrical device, said power line cord having an electromagnetic shield; and a filter means arranged in series between said power line cord and the device, said filter means comprising a plurality of inductors, each inductor connected in-line with a respective one of said mains, a capacitor shunt-connected across said mains and a resistor shunt-connected across said mains, wherein said power line cord shield is connected to ground only at the second end of said power line cord.

10. A power line cord filtering assembly according to claim 9 and wherein said shield extends to substantially cover the plug and the filter.

11. A power line cord filtering assembly according to claim 9 and wherein said shield extends continuously from the power line cart and over the plug and filter so as to eliminate regions where electromagnetic radiation can penetrate.

12. A power line cord filtering assembly according to claim 9 and wherein the connection between the shield and ground is a low impedance connection.

13. A power line cord filtering assembly according to claim 9 and where a capacitance exists between the shield and a ground lead of said power line cord and has a value of at least 1000 picofarads.

* * * * *